US007374123B2

(12) United States Patent
Han

(10) Patent No.: US 7,374,123 B2
(45) Date of Patent: May 20, 2008

(54) REWIND MECHANISM

(75) Inventor: Joseph Unkyung Han, Irvine, CA (US)

(73) Assignee: Louis A. Kish, Santa Ana, CA (US)

( * ) Notice: Subject to any disclaimer, the term of this patent is extended or adjusted under 35 U.S.C. 154(b) by 0 days.

(21) Appl. No.: 11/470,101

(22) Filed: Sep. 5, 2006

(65) Prior Publication Data

US 2008/0054116 A1 Mar. 6, 2008

(51) Int. Cl.
*B65H 75/48* (2006.01)

(52) U.S. Cl. ..... 242/385.2

(58) Field of Classification Search ..... 242/385, 242/385.1, 385.2, 385.3, 385.4, 378, 378.1, 242/378.2
See application file for complete search history.

(56) References Cited

U.S. PATENT DOCUMENTS

| | | | | |
|---|---|---|---|---|
| 2,393,417 | A * | 1/1946 | Ruttkay | |
| 2,478,025 | A * | 8/1949 | Taylor | |
| 2,521,178 | A | 9/1950 | Meletti | |
| 3,450,369 | A * | 6/1969 | Olzak et al. | 242/385.1 |
| 3,895,764 | A * | 7/1975 | Roland | 242/378.2 |
| 4,854,522 | A * | 8/1989 | Brown et al. | 242/385.2 |
| 5,481,607 | A | 1/1996 | Hsiao | |
| 6,381,665 | B2 | 4/2002 | Pawlowski | |
| 6,536,697 | B2 | 3/2003 | Tsan | |
| 6,736,346 | B1 | 5/2004 | Park | |
| 2005/0011982 | A1 | 1/2005 | Salentine et al. | |

* cited by examiner

*Primary Examiner*—William A. Rivera

(57) ABSTRACT

A mechanism for rewinding flexible members onto a spool is described. The inventive rewind mechanism permits a flexible member to be pulled outside its housing and remain outside the housing without a rewind force on the flexible member simply by pulling on the flexible member and releasing it. The flexible member is rewound into the housing simply by pulling and releasing it again.

20 Claims, 5 Drawing Sheets

REWIND MECHANISM

CROSS-REFERENCE TO RELATED APPLICATIONS

Not applicable.

STATEMENT REGARDING FEDERALLY SPONSORED RESEARCH

Not applicable.

REFERENCE TO SEQUENCE LISTING

Not applicable.

FIELD OF THE INVENTION

The present invention relates to rewind mechanisms, and particularly to mechanisms permitting a flexible member to be pulled from the mechanism and remain outside the mechanism without exerting a retracting force until the flexible member is pulled again to activate a retracting force. The present invention also relates to rewind mechanisms where interrupting the retracting force can be prevented so that the retracting force constantly acts on the flexible member.

BACKGROUND OF THE INVENTION

The present invention improves upon currently available rewind mechanisms by reliably permitting tension on a flexible member to be relieved, and reintroduced, simply by pulling on the flexible member.

Many applications where a flexible member is pulled from its housing require the flexible member to remain outside the housing for a period of time. These applications also require the flexible member to be retracted into the housing at a later time. Examples include retractable cords on items such as a computer mouse or a vacuum cleaner; earphones connected to an MP3 player or other audio/video device; air hoses; garden hoses; tether lines such as a writing implement retained on a string; display screens; window blinds; electrical power cords and tape measures.

A common need among the above examples is a user's desire to pull a length of the flexible member from the housing. Users also want the pulled length to remain outside the housing without any tension on the flexible member while the user uses either the flexible member itself or something attached to the flexible member. However, the flexible member is most neatly stored within its housing and users desire the flexible member to return to the housing when they are finished using the flexible member or item attached to the flexible member. Ideally, the flexible member automatically rewinds into its housing when a user is finished with the flexible member.

Currently available rewind mechanisms typically operate in one of three manners. The first manner is a rewind mechanism requiring manual rewinding. For example, many chalk lines used in construction to mark a straight line require a user to turn a small crank in order to rewind the chalk line into its housing. Extraordinarily long tape measures, garden hose reels and some air hose reels also require manual cranking in order to return the flexible member to its housing. The disadvantage of such a manner is two-fold.

First, it requires a user to be proximate the housing in order to rewind the flexible member, and second it often requires two hands and is slow.

The second manner constantly exerts a rewind, or retraction, force on a flexible member—typically by increasingly tensioning a torsion spring as a flexible member is pulled out of the rewind mechanism's housing. Clothesline retraction mechanisms often operate in such a manner as well as some air hose mechanisms and tether lines. The obvious drawback is that a user is constantly fighting the rewind force while using the flexible member.

Tape measures also fall into this category. Most tape measures overcome the constant exertion of the retraction force through a mechanical slide which is operated as a brake on the flexible member to prevent its rewind. The main disadvantages with such a mechanical brake on the flexible member are that it tends to wear, becoming less effective over time, and it requires dexterity to operate with one hand, or if hands are too small, two hands (one to hold the housing and the other to operate the brake).

The third manner of operation for rewind mechanisms is to automatically interrupt the retraction force when a user stops pulling on the flexible member. The retraction force is typically created similarly to the retraction force used in the second manner of rewind mechanisms, namely by increasingly tensioning a torsion spring as the flexible member is pulled from its housing. These devices also reintroduce the retraction force when the user pulls on the flexible member a second time, thus providing one-handed retraction.

The drawback with current devices falling into the third manner is that they are not reliable. Current devices are delicate and may work for a limited number of iterations before breaking down, resulting in a constant retraction force exerted on the flexible member. Or, they do not work reliably at all because they require a specific orientation to function while a user requires the device to be in a different orientation.

An exemplary device for the third manner is shown in U.S. Pat. No. 6,736,346 ("'346 patent") to Park. The device disclosed in the '346 patent contains a torsion spring 400 which exerts a retraction force on flexible member 500 when it is pulled from housing 130, 140. A ball 300 acts in combination with track 170 to interrupt the retraction force from acting on flexible member 500 and to reintroduce the retraction force to rewind flexible member 500 in response to a user pulling on flexible member 500.

As described in the '346 patent the ball 300 is free-floating, that is not guided by a spring force or otherwise. Operation of the '346 patent's device thus relies upon the unguided ball 300 correctly moving through track 170, making the device susceptible to unreliability. For example, any wear in the track 170 (generally a low density material such as plastic) affects how ball 300 (generally made of metal or other dense material) moves and may prevent ball 300 from being in the correct portion of track 170 at any given time. Or, if stop area 174 wears, ball 300 will not be able to prevent the rewinding of flexible member 500.

Another example of unreliability is if the device disclosed in the '346 patent is tilted or upside down. The '346 patent's device is designed to operate optimally when track 170 is orthogonal to gravitational forces. Orienting the device other than orthogonally to gravitational forces may cause the ball 300 to rest in one portion of track 170, or if upside down may decrease the frictional forces acting on the ball 300 to the point where it does not move through track 170 at all. The frictional forces on ball 300 are also a function of how tightly housing halves 130, 140 are compressed together— not enough compression leaves ball 300 too free and prevents its proper movement through track 170, whereas too much compression keeps ball 300 stopped in one place and may cause the device to "seize."

Other devices displaying the third manner of operation, such as those disclosed in U.S. Pat. Nos. 6,318,665 to King, 5,481,607 to Hsiao, 2,521,178 to Meleth and U.S. Published App. No. 2005/0011982 to Salentine et al. have a fairly complex arrangement of levers, stops and springs which are prone to breaking or wearing to the point where they no longer function properly.

The device disclosed in U.S. Pat. No. 6,536,697 to ("'697 patent") provides a mechanism that prevents a flexible member from being rewound until a user desires. However, the '697 patent's device does not operate simply by pulling on the flexible member. It requires a user to tilt engaging member 60 into a lock position and out of the lock position. Additionally, engaging member 60 contacts ratchet wheel 50 while the flexible member is being pulled, thus causing excessive wear to engaging member 60 and ratchet wheel 50.

BRIEF SUMMARY OF THE INVENTION

There is a need for a rewind mechanism with a high level of reliability. There is also a need for a rewind mechanism with a simple, one-handed operation. There is a further need for a rewind mechanism that is simply constructed and durable.

These needs and others are met by embodiments of the present invention, which provide a rewind mechanism for automatically rewinding a flexible member when a user desires. A rewind mechanism comprises a housing with an opening configured to permit a flexible member to pass through the opening and a spool rotatably connected to the inside of the housing. The spool is configured to have a flexible member wound onto it, and a portion of the spool is configured to engage a stop element. A biasing element is configured to apply a force to the spool in a direction that rotates the spool to wind a flexible member onto the spool. There is a track inside the housing. An arm attached inside the housing has a portion configured to engage a flexible member, a stop portion configured to engage the portion of the spool that is configured to engage a stop element, and a guide portion configured to interact with the track inside the housing.

Other embodiments of a rewind mechanism comprise a housing with an opening configured to permit a flexible member to pass through the opening and a spool rotatably connected to the inside of the housing. The spool is configured to have a flexible member wound onto it and there is a flexible member wound onto the spool with a portion of the flexible member extending outside the housing. A portion of the spool is configured to engage a stop element. There is a biasing element configured to apply a force to the spool in a direction that rotates the spool to wind a flexible member onto the spool, and a track inside the housing. An arm is also attached inside the housing and comprises a portion configured to engage a flexible member when the flexible member is pulled and further configured to rotate the arm away from the spool when the flexible member is pulled. The arm also comprises a stop portion configured to engage the portion of the spool that is configured to engage a stop element; and a guide portion configured to interact with the track inside the housing.

Embodiments of the present invention overcome the difficulty of providing reliable operation. This is accomplished by a simply constructed device providing a guided, positive stopping mechanism which operates the same regardless of its orientation to gravitational forces. The mechanism may also wear over the course of time without substantially altering its performance.

Embodiments of the present invention also overcome the difficulty of providing simple, one-handed operation. The present invention consistently alternates between interrupting a retracting force acting on a flexible member and permitting a retracting force to act on a flexible member merely by pulling on the flexible member. No slides, levers or tilting engaging members are required by embodiments of the present invention. Other embodiments of the present invention also permit a constant retracting force to be applied to a flexible member based on a user's need.

Embodiments of the present invention are also simply constructed of durable materials. Due to the simple construction of embodiments of the present invention it is durable and long-lasting.

Additional advantages and novel features of the invention will be set forth in part by the description which follows, and in part will become apparent to those skilled in the art upon examination of the following or may be learned by practice of the invention. The advantages of the invention may be realized and attained by the instrumentalities and combinations, particularly pointed out in the appended claims.

BRIEF DESCRIPTION OF THE DRAWINGS

The present invention is illustrated by way of example, and not by way of limitation in the figures of the accompanying drawings in which like reference numerals refer to similar elements and in which.

DETAILED DESCRIPTION

The present invention addresses and solves problems related to flexible member rewind mechanisms, particularly where current mechanisms do not permit simple, one-handed operation for interrupting a rewinding force and applying a rewinding force. The present invention also addresses and solves problems related to providing a rewind mechanism which reliably operates, is durable and simple to construct.

The present invention solves the above problems by providing a mechanism as discussed below. One of ordinary skill in the art will realize that the following discussion is illustrative and intended to describe preferred embodiments of the present invention and is not intended to limit the present invention to the embodiments discussed. The present invention has numerous applications where a flexible member is pulled from a housing and stored within the housing. The present invention may be scaled and adapted to many applications and is defined by the claims, which set forth the metes and bounds of the present invention.

Figure 1:
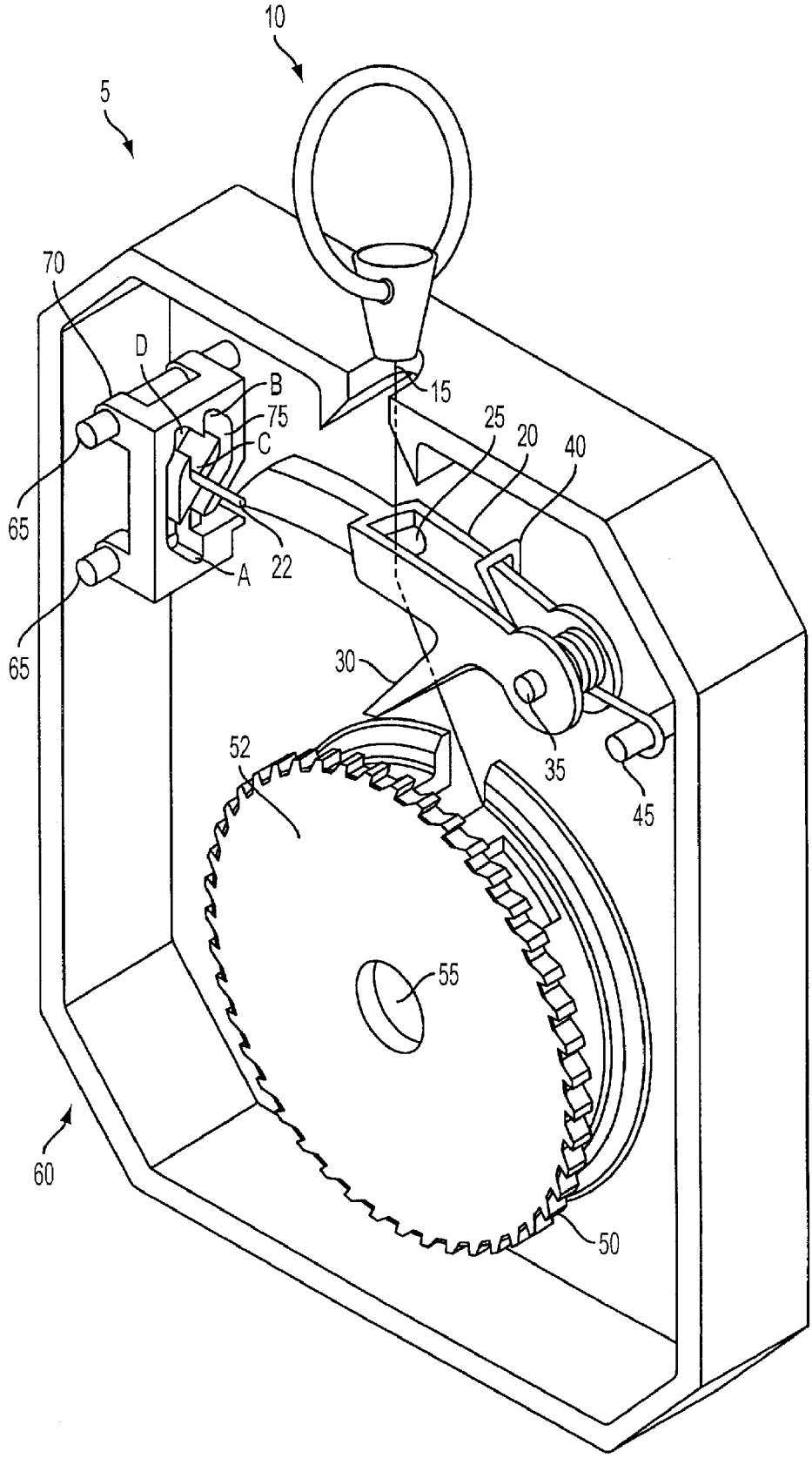
FIG. 1 is a front perspective view of an embodiment of the invention depicting the arm 20 in a first position.

Referring now to the drawings, and initially to FIG. 1, a rewind mechanism 5 is described. A housing comprises a first portion 60 in which the rewind mechanism is mounted and a second portion (not depicted for illustrative purposes) that closes the housing. The second portion is attached to the first portion, for example, by gluing, welding or an inner lip which is press fit into the first portion 60 as is well known in the art.

Flexible member 15 is wound around the central axis 55 of spool 52. For illustrative purposes, only a segment of flexible member 15 is shown. However, one of ordinary skill in the art will realize that nearly any desired length of flexible member 15 may be wound onto spool 52 depending upon the dimensions of spool 52.

Spool 52 is rotatably mounted within housing 60 as is well known in the art. Spool 52 is biased to rotate in a clockwise direction by a biasing element, for example, a helix, torsion or coil spring (not shown), as is well known in the art. Exemplary manners for biasing spool 52 to rotate are described in U.S. Pat. Nos. 2,521,178 to Meleth (see FIG. 1 and corresponding description), 5,481,607 to Hsiao (see FIG. 5 and corresponding description), 6,536,697 to Tsan (see FIGS. 3 and 7 and corresponding descriptions) and 6,736,346 to Park (see FIG. 3 and corresponding description); all of which are fully incorporated herein by reference. The biasing element (not shown) rotates spool 52 in order to rewind flexible member 15 after it has been pulled out of housing 60. As is well understood by one of ordinary skill in the art the rotation direction of the biasing element could be reversed with simple modifications to teeth 50 on spool 52, to stop arm 30 and to the biasing element (not shown).

Attachment device 10 is connected to flexible member 15 and is dimensioned to prevent flexible member 15 from being completely wound around central axis 55. This prevents flexible member 15 from being completely withdrawn within housing 60 where a user cannot grasp it. Attachment device 10 is also configured to permit items to be rapidly attached and detached to and from flexible member 15 as is well known in the art. For example, attachment device 10 can be a quick release device, a clip device, a split ring, a small carabineer or a pencil/pen/stylus holder as described in U.S. Pat. No. 6,854,681 to Kish.

Another manner for preventing flexible member 15 from completely withdrawing into housing 60 is to configure the biasing element to stop rewinding before a free end of flexible member 15 disappears into housing 60.

Arm 20 is pivotally mounted about pin 35 within housing 60. In FIG. 1, pin 35 is molded as an integral part of housing 60. Pin 35 could also be fixed to housing 60 in any well known manner such as, but not limited to, a bolt or other threaded fastener, gluing, welding or a rivet. A spring 40 engages arm 20 and housing 60 via post 45. Spring 40 biases arm 20 towards spool 52. Alternatively, arm 20, or select portions of arm 20, are made from an elastic material, for example a flexible plastic or spring steel. In these alternative embodiments, arm 20 is rigidly attached to pin 35, or directly to housing 60. In these alternative embodiments, spring 40 is not needed to bias arm 20 towards spool 52 as the elastic deformation of arm 20 will bias arm 20 towards spool 52.

Arm 20 is configured with an opening containing a post 25. In FIG. 1 post 25 is fixed at both ends to arm 20 and is made from a smooth material that provides frictional engagement with flexible member 15. For example, depending upon the amount of friction required to move arm 20, post 25 can be made of a hard material, such as plastic, steel or a ceramic or glass, or post 25 can be made of a hard material covered with a softer material, for example a hard plastic covered with a softer plastic or a durable rubber such as Santoprene®. An alternative construction for post 25 is to make post 25 with a rotatable cover over it, for example a bushing or nylon sleeve, which will provide frictional engagement for flexible member 15 and decrease the wear caused by flexible member 15 passing over post 25.

Figure 5:
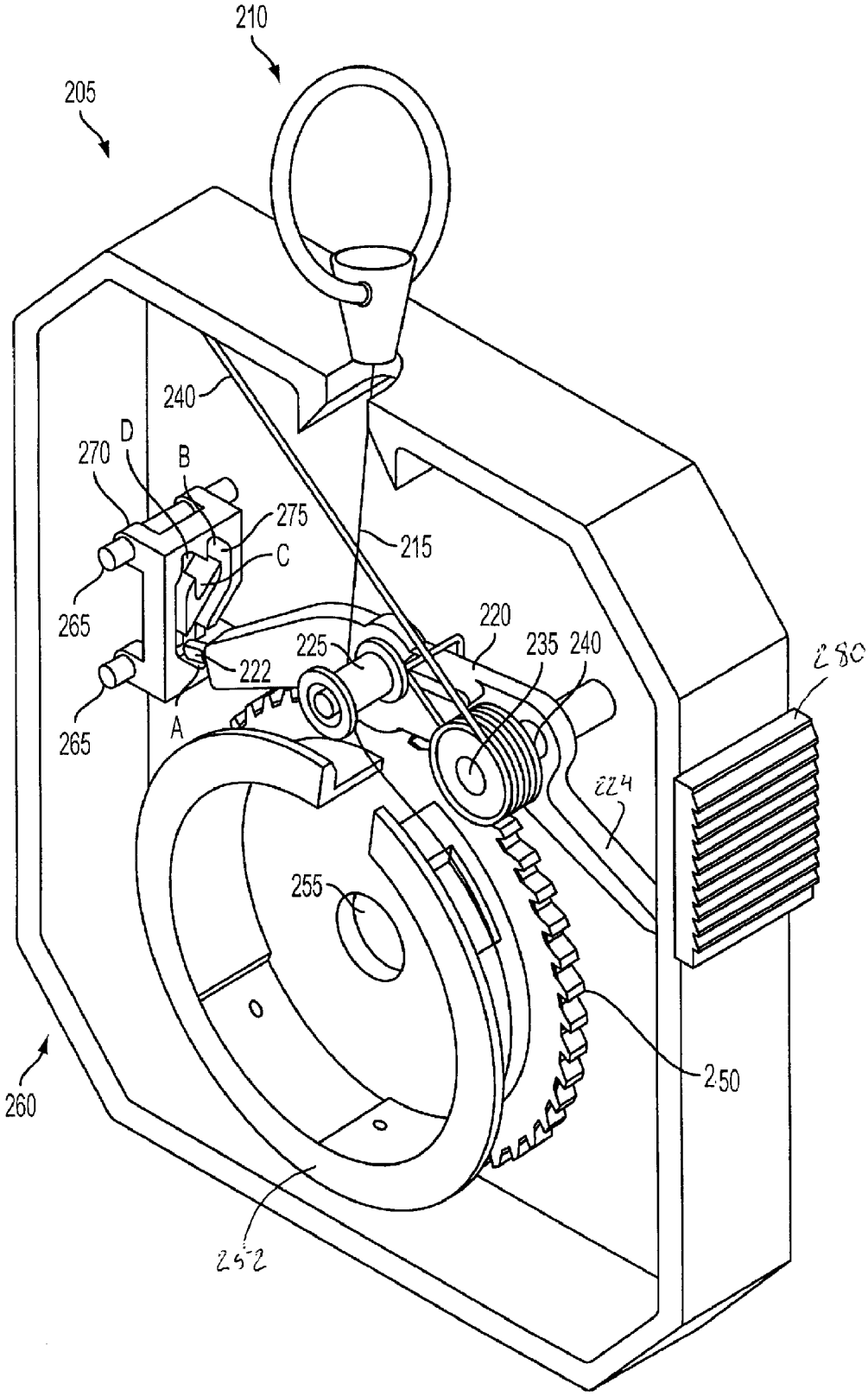
FIG. 5 is a front perspective view of the preferred embodiment of the invention.

An alternate construction for post 25 within arm 20 is to place post 25 in a position (for example, moving post 25 in the direction towards guide post 22) where flexible member 15 engages, e.g., is pinched by, both post 25 and arm 20. For such an embodiment, arm 20 does not need to be made from a flexible material and spring 40 is not needed. The force of flexible member 15 moving between post 25 and arm 20 is sufficient to rotate arm 20 away from spool 52 when flexible member 15 is pulled. The force of flexible member 15 moving between post 25 and arm 20 is also sufficient to rotate arm 20 towards spool 52 when flexible member 15 is rewound by the biasing element (not shown). In such an embodiment, there is always resistance to movement of flexible member 15. Referring to FIG. 5, such an embodiment placing constant resistance to movement of flexible member 215 is made, for example, by wrapping one or more complete turns of flexible member 215 onto guide roller 225.

Referring again to FIG. 1, flexible member 15 is positioned through the opening in arm 20 and interacts with post 25 in such a manner that pulling on flexible member 15 places a force (Force A in FIGS. 2 and 4), for example through friction, on post 25. The force resulting from pulling flexible member 15 outside housing 60 overcomes the biasing force from spring 40 (or the internal force of arm 20 if it is a flexible material rigidly attached to pin 35 or housing 60) and causes arm 20 to rotate away from spool 52.

Guide post 22 on arm 20 is configured to interact with a track 75 contained on plate 70. Stop arm 30 on arm 20 is configured to interact with teeth 50 on spool 52 in a manner that prevents the biasing element (not shown) from rotating spool 52. The present invention is not limited to a ratchet and pawl type stop mechanism, but uses any suitable mechanism such as frictional engagement or a post that fits into grooves or holes, for example.

Plate 70 is slidably mounted within housing 60 on posts 65. Other manners for slidably mounting plate 70, for example on a flexible beam extending from a wall of housing 60, or a ball joint sliding within a groove are also covered by the present invention. As arm 20 and guide post 22 rotate away from and towards spool 52 guide post 22 impacts walls within track 75. Guide post 22 impacting the walls within track 75 causes plate 70 to slide on posts 65 which permits guide post 22 to move between positions C, D, B and A within track 75. Alternatively, guide post 22, and/or arm 20 (or select portions of arm 20), can be made from an elastic material (as described above) and plate 70 can be fixedly mounted within housing 60. Such an embodiment permits guide post 22 to move between positions C, D, B and A by impacting walls within plate 70 and deflecting enough to be guided to one of positions C, D, B or A. Another alternative construction used with an elastic guide post 22 and/or arm 20 is to make track 75 directly in the wall of housing 60 so that no plate 70 is required. In FIG. 1 track 75 is depicted with an opening to the outside of plate 70. The opening to the outside of plate 70 is to facilitate assembling the rewind mechanism 5 by making it easier to insert guide post 22 into track 75. The opening to the outside of plate 70 is not necessary to the functioning of rewind mechanism 5.

Referring now to FIGS. 1 through 4, operation of the depicted embodiment of the inventive rewind mechanism 5 is described. With flexible member 15 fully wound around central axis 55, e.g., with attachment device 10 abutting housing 60 or with the biasing element (not shown) not exerting any rotational force upon spool 52, guide post 22 rests in position C within track 75 as depicted in FIG. 1. While guide post 22 rests in position C, stop arm 30 does not interact with teeth 50 on spool 52.

Figure 2:
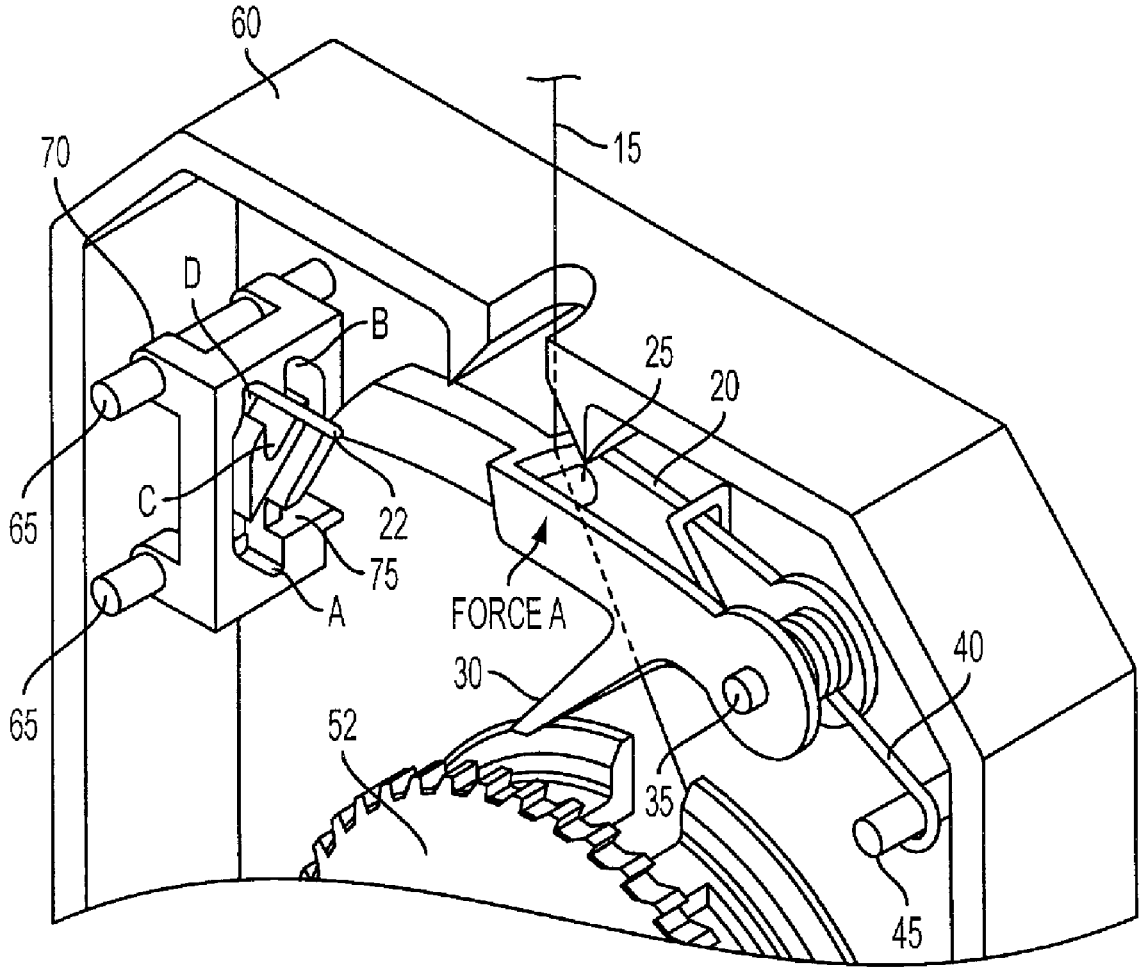
FIG. 2 is a front perspective view of the embodiment of FIG. 1 depicting the arm 20 in a second position.

Referring now to FIG. 2, flexible member 15 is pulled from housing 60 which exerts Force A upon post 25. The force upon post 25 is sufficient to overcome the force exerted by spring 40, or the internal stiffness of arm 20 if it is rigidly attached to pin 35 or housing 60 in other embodiments, and causes arm 20 to rotate away from spool 52. As arm 20 rotates away from spool 52 guide post 22 moves within track 75, impacts a wall within track 75 sliding plate 70 on posts 65 and relocating to position D. While flexible member 15 is being pulled from housing 60 guide post 22 remains in position D. Stop arm 30 remains free from engaging teeth 50 and spool 52 rotates as flexible member 15 is pulled from housing 60. Pulling flexible member 15 also transfers mechanical energy to the biasing element (not shown) so that the biasing element has enough energy to completely rewind flexible member 15 about central axis 55.

Figure 3:
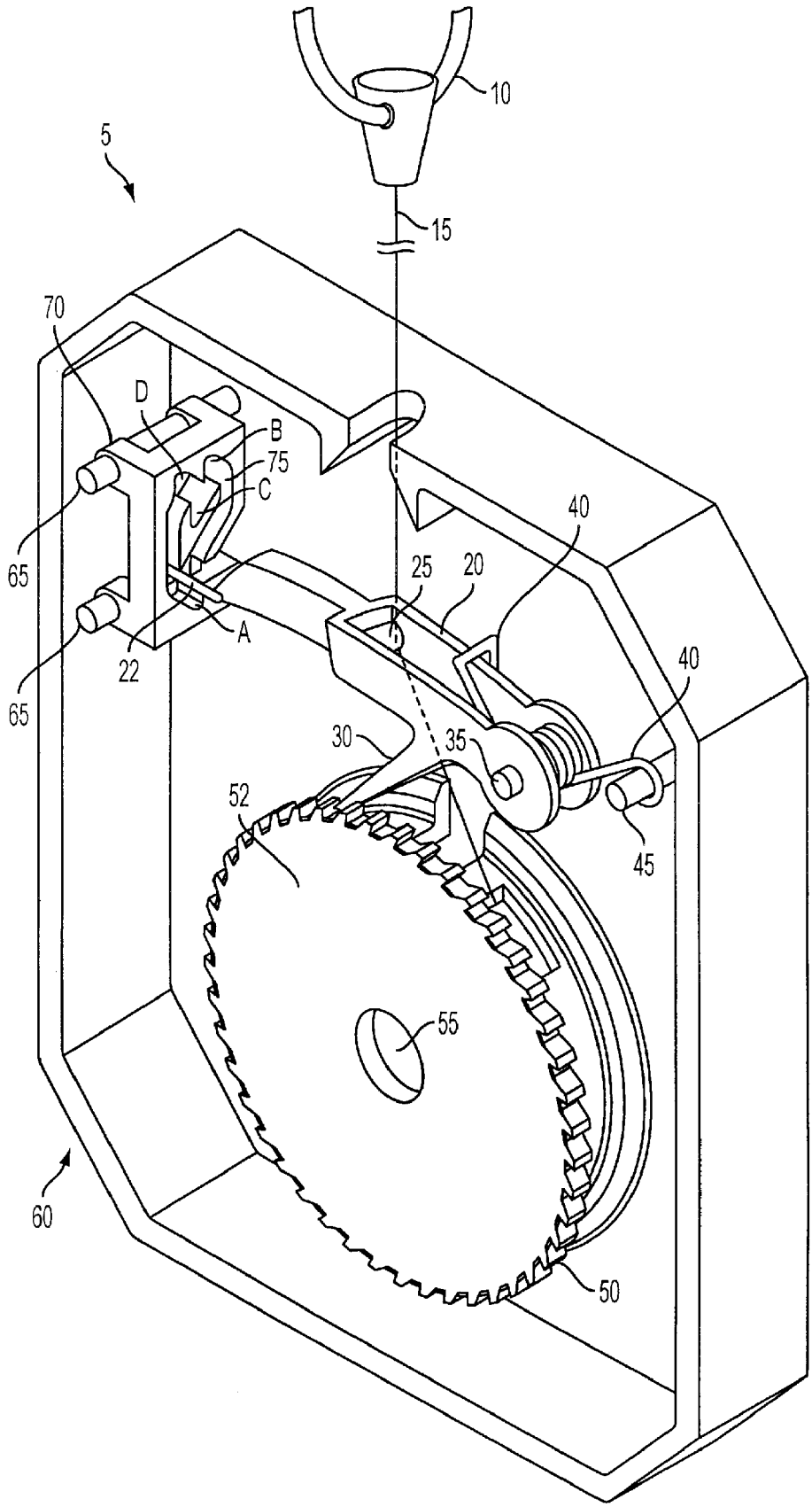
FIG. 3 is a front perspective view of the embodiment of FIG. 1 depicting the arm 20 in a third position.

Referring now to FIG. 3, when flexible member 15 is no longer pulled from housing 60 Force A exerted on post 25 subsides and spring 40, or the internal stiffness of arm 20, or the resistance to movement of flexible member 15 through arm 20, causes arm 20 to rotate towards spool 52. As arm 20 moves towards spool 52 the biasing element (not shown) rotates spool 52 and rewinds a small amount of flexible member 15 about central axis 55. Guide post 22 impacts a wall within track 75 sliding plate 70 on posts 65 and moving from position D to position A. As illustrated in FIG. 3, arm 20 is still rotating towards spool 52, and guide post 22 is moving into position A. Alternatively, guide post 22 and/or arm 20 have enough flex to move through track 75 when plate 70 is fixedly mounted within housing 60 or when track 75 is directly formed in a wall of housing 60. With guide post 22 in position A, stop arm 30 interacts with teeth 50 to prevent spool 52 from rotating and further rewinding flexible member 15 about central axis 55. While guide post 22 remains in position A stop arm 30 prevents spool 52 from rotating due to the force exerted by the biasing element (not shown). The portion of flexible member 15 which was pulled from housing 60 remains outside housing 60 without any tension placed on it by the biasing element (not shown).

Figure 4:
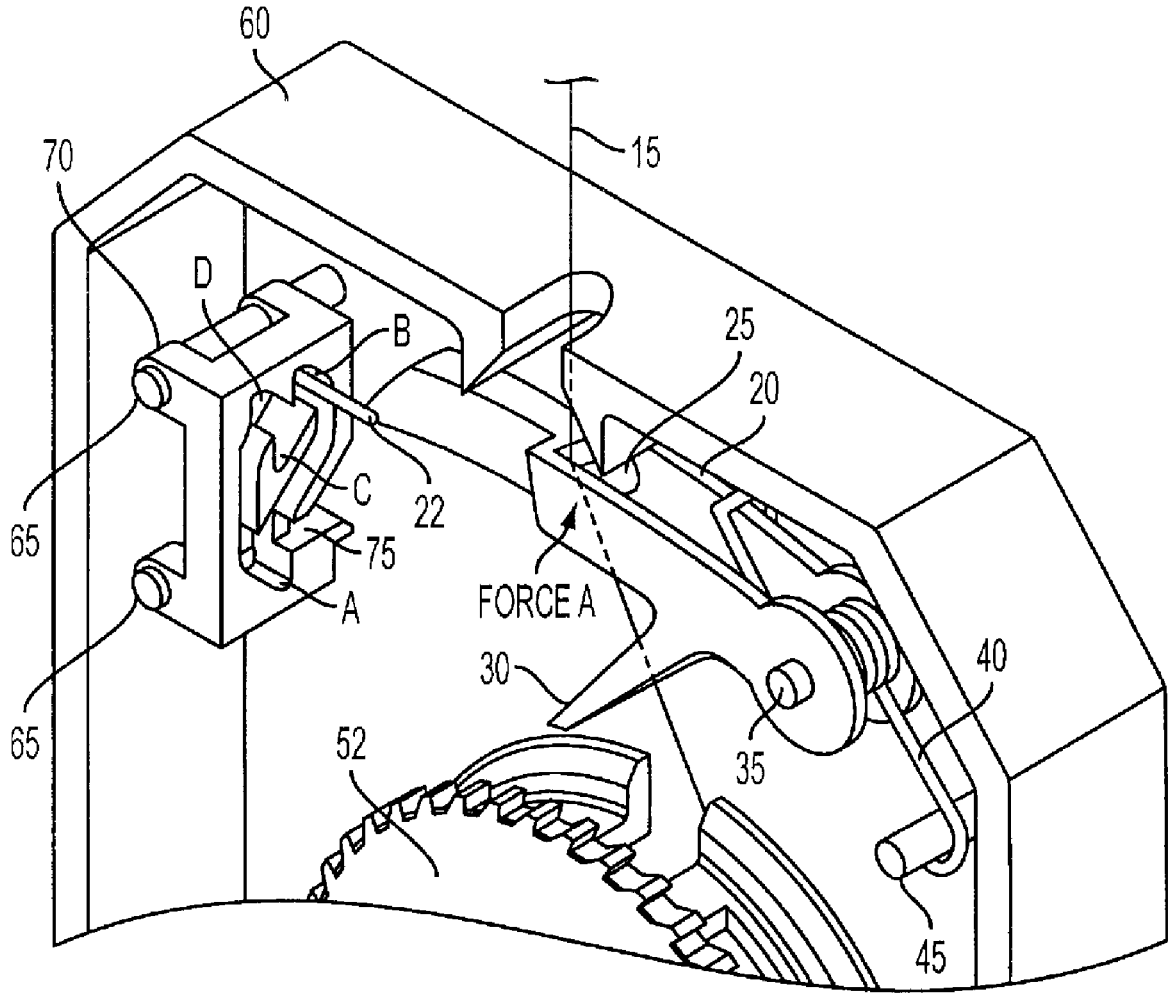
FIG. 4 is a front perspective view of the embodiment of FIG. 1 depicting the arm 20 in a fourth position.

Referring now to FIG. 4, when it is desired to rewind flexible member 15 about central axis 55 within housing 60 an additional amount of flexible member 15 is pulled from housing 60. This exerts Force A upon post 25 which, again, is sufficient to overcome the force exerted by spring 40, or the internal stiffness of arm 20 if it is rigidly attached to pin 35 or housing 60, causing arm 20 to rotate away from spool 52. As arm 20 rotates away from spool 52 guide post 22 moves within track 75, impacts a wall within track 75 sliding plate 70 on posts 65 and relocates to position B. While the additional amount of flexible member 15 is being pulled from housing 60 guide post 22 remains in position B. Stop arm 30 is moved free from engaging teeth 50 and spool 52 rotates as flexible member 15 is pulled from housing 60. Pulling flexible member 15 also transfers additional mechanical energy to the biasing element (not shown) so that the biasing element has enough energy to completely rewind flexible member 15 about central axis 55.

Referring now to FIG. 1, after an additional amount of flexible member 15 is pulled from housing 60 flexible member 15 is released. The Force A exerted on post 25 subsides and spring 40, or the internal stiffness of arm 20, causes arm 20 to rotate towards spool 52. As arm 20 moves towards spool 52 the biasing element (not shown) rotates spool 52 and rewinds flexible member 15 about central axis 55. Guide post 22 impacts a wall within track 75 sliding plate 70 on posts 65 and moves from position B to position C. Stop arm 30 is held free from teeth 50 to allow spool 52 to rotate and further rewind flexible member 15 about central axis 55. The portion of flexible member 15 which was pulled from housing 60 is rewound within housing 60 by the biasing element (not shown).

Flexible member 15 can be completely rewound into housing 60 while guide post 22 remains in position C. Rewinding stops when attachment device 10 abuts housing 60, or when the biasing element stops rotating spool 52—depending upon the design as discussed above. Additionally, rewinding can be interrupted by pulling on flexible member 15. As described above in relation to FIG. 2, guide post 22 will move to position D upon pulling flexible member 15. Guide post 22 will then move to position A, as described above in relation to FIG. 3, when flexible member 15 is no longer pulled. Any portion of flexible member 15 that is outside housing 60 will remain outside housing 60 at this time. Thus, the portion of flexible member 15 outside housing 60 can be shortened (or lengthened) without first rewinding all of flexible member 15 into housing 60.

The embodiment of the inventive rewind mechanism depicted in FIG. 1 is also designed to prevent flexible member 15 from becoming locked outside housing 60. One end of flexible member 15 is securely attached to spool 52 as is well known in the art. Thus, it is possible to pull flexible member 15 outside housing 60 until only the portion of flexible member extending from its attachment point to spool 52 to the opening in housing 60 remains within housing 60. In the event that flexible member 15 is pulled this far outside housing 60 the distance guide post 22 must move from position D to position A within track 75 is far enough to rewind a sufficient amount of flexible member 15 onto spool 52 to permit guide post 22 to move from position A to position B. Thus, pulling out too much of flexible member 15 to prevent guide post 22 from moving between positions C, D, B and A within track 75 is avoided.

Referring now to FIG. 5, a preferred embodiment of the inventive rewind mechanism 205 is described. A housing comprises a first portion 260 in which the rewind mechanism is mounted and a second portion (not depicted) that closes the housing. The second portion is attached to the first portion, for example, by gluing, welding or an inner lip which is press fit into the first portion as is well known in the art.

Flexible member 215 is wound around the central axis 255 of spool 252. Spool 252 is rotatably mounted within housing 260 as is well known in the art. Spool 252 is biased to rotate in a clockwise direction by a biasing element, for example, a torsion or coil spring (not shown), as is well known in the art. The biasing element (not shown) rotates spool 252 in order to rewind flexible member 215 after it has been pulled out of housing 260. As is well understood by one of ordinary skill in the art the rotation direction of the biasing element could be reversed with simple modifications to teeth 250 on spool 252 and to stop arm 230.

Attachment device 210 is connected to flexible member 215 and is dimensioned to prevent flexible member 215 from being completely wound around central axis 255. This prevents flexible member 215 from being completely withdrawn within housing 205 where a user cannot grasp it. Although illustrated as proximate to housing 260 in FIG. 5, for simplicity, one of ordinary skill in the art will realize that attachment device 210 will not abut housing 260 with guide post 222 in position A. Attachment device 210 will abut housing 260 when guide post 222 is in position C. Attachment device 210 is also configured to permit items to be rapidly attached and detached to and from flexible member 215 as is well known in the art. For example, attachment device 210 can be a quick release device, a clip device, a split ring, a small carabineer or a pencil/pen/stylus holder as described in U.S. Pat. No. 6,854,681 to Kish.

Another manner for preventing flexible member 215 from completely withdrawing into housing 260 is to configure the biasing element to stop rewinding before a free end of flexible member 215 disappears into housing 260.

Arm 220 is pivotally mounted about pin 235 within housing 260. In FIG. 5, pin 235 is molded as an integral part of housing 260. Pin 235 could also be fixed to housing 260 in any well known manner such as, but not limited to, a bolt or other threaded fastener, gluing, welding or a rivet. A spring 240 engages arm 220 and an internal wall of housing 260. Spring 240 biases arm 220 towards spool 252. Alternatively, arm 220, or select portions of arm 220, are made from an elastic material, for example a flexible plastic or spring steel. In these alternative embodiments, arm 220 is rigidly attached to pin 235, or directly to housing 260. In these alternative embodiments, spring 240 is not needed to bias arm 220 towards spool 252 as the elastic deformation of arm 220 will bias arm 220 towards spool 252.

Arm 220 is configured with a guide roller 225. In FIG. 5 guide roller 225 is attached to arm 220, for example by a press fit. Alternatively, guide roller can be made as an integral part of arm 220. Guide roller 225 is configured to have a rolling element, for example a plastic or metal bushing or a nylon sleeve, which provides rolling engagement for flexible member 215. Alternatively (not shown), guide roller 225 is made from a smooth material that provides non-rolling engagement with flexible member 215. For example, depending upon the amount of friction required to move arm 220, guide roller 225 can be made of a hard material, such as plastic, steel, ceramic or glass, or guide roller 225 can be made of a hard material covered with a softer material, for example a hard plastic covered with a softer plastic or a durable rubber such as Santoprene®. In this alternative embodiment, guide roller 225 does not have a rolling element and the flexible member 215 passes over a fixed guide roller 225—which is actually a post. Guide roller 225 is configured to flare at the end distal from arm 220 (or to have a lip or rim) in order to prevent flexible member 215 from disengaging guide roller 225.

Flexible member 215 engages guide roller 225 in such a manner that pulling on flexible member 215 places a force on guide roller 225. The force resulting from pulling flexible member 215 outside housing 260 overcomes the biasing force from spring 240 (or the internal force of arm 220 if it is a flexible material rigidly attached to pin 235 or housing 260) and causes arm 220 to rotate away from spool 252.

Guide post 222 on arm 220 is configured to interact with a track 275 contained on plate 270. Stop arm 230 on arm 220 is configured to interact with teeth 250 on spool 252 in a manner that prevents the biasing element (not shown) from rotating spool 252.

Switch 280 is slidably mounted to housing 260 with a portion external to housing 260 and a portion internal to housing 260. The external portion of switch 280 is engaged by a user to move the switch 280 between two positions. In the first position, switch 280 does not engage arm 220 and the rewind mechanism 205 operates in a manner similar to that described in relation to FIGS. 1 through 4 above. In the second position, the internal portion of switch 280 engages arm 220 and overcomes the biasing force from spring 240 (or the internal force from a flexible arm 220) to rotate arm 220 away from spool 252. In the second position, switch 280 prevents the rewind mechanism 205 from operating as described in relation to FIGS. 1 through 4. Instead, the rewind mechanism 205 operates by constantly exerting a rewind force upon flexible member 215 by the biasing element (not shown) acting to rotate spool 252.

Instead of utilizing a switch 280 the portion 224 of arm 220 that engages switch 280 is configured to extend outside housing 260 in another embodiment. With portion 224 outside housing 260, and housing 260 configured to hold portion 224 in one of two positions as is well known in the art, the rewind mechanism 205 can be selected to operate either as described in relation to FIGS. 1 through 4 above or with a constant rewind force on the flexible member 215.

Plate 270 is slidably mounted within housing 260 on posts 265. Other manners for slidably mounting plate 270, for example on a flexible beam extending from a wall of housing 260, or a ball joint sliding within a groove are also covered by the present invention. As arm 220 and guide post 222 rotate away from and towards spool 252 guide post 222 impacts walls within track 275. Guide post 222 impacting the walls within track 275 causes plate 270 to slide on posts 265 which permits guide post 222 to move between positions C, D, A and B within track 275. Alternatively, guide post 222, and/or arm 220 (or select portions of arm 220), can be made from an elastic material (as described above) and plate 270 can be fixedly mounted within housing 260. Such an embodiment permits guide post 222 to move between positions C, D, A and B by impacting walls within plate 270 and deflecting enough to be guided to one of positions C, D, A and B. Another alternative construction used with an elastic guide post 222 and/or arm 220 is to make track 275 directly in the wall of housing 260 so that no plate 270 is required. In FIG. 5 track 275 is depicted with an opening to the outside of plate 270. The opening to the outside of plate 270 is to facilitate assembling the rewind mechanism 205 by making it easier to insert guide post 222 into track 275. The opening to the outside of plate 270 is not necessary to the functioning of rewind mechanism 205. Pulling on and releasing flexible member 215 operates rewind mechanism 205 in the same manner as described for rewind mechanism 5 above.

While the depicted embodiments for the inventive rewind mechanism show a narrow, thin flexible member 15, 215 the present invention is not limited to such flexible members. For example, the present invention can be used for wide flexible members such as flexible display screens (such as those being developed by Philips and Plastic Logic Ltd.) or window shades. In order to adapt the embodiment depicted in FIG. 5 to a wide flexible member the guide roller 225 depicted in FIG. 5 is made long enough to accommodate the width of the flexible member. The spool 252 has central axis 255 extended a distance sufficient to accommodate the width of the flexible member. In an alternate embodiment, a spool 252 with an extended central axis 255 has teeth 250 on both rims. This embodiment permits two arms 220 to be employed (one a mirror image of the other and placed within housing 260 at either end of the wide flexible member) with a guide roller 225 extending between the two arms 220. Likewise, one of ordinary skill in the art appreciates that the embodiment depicted in FIG. 1 can be extended to accommodate wide flexible members by extending central axis 55, post 25 and the opening in arm 22 that contains post 25.

Other applications for the present invention include rewinding garden and air hoses. The present invention can also be used to rewind and store electrical cords, cords for earphones, computer mice and other electronics requiring wires. As described in relation to wide flexible members the present invention can also be used as a retractable reel in a car, for example for rewinding seatbelts. The present invention's uses also include tape measures, chalk lines (used for marking straight lines), rope storage, clothes lines and many others.

While this invention has been described in connection with what is presently considered to be the most practical and preferred embodiment, it is to be understood that the invention is not limited to the described embodiments, but, on the contrary, is intended to cover various modifications and equivalent arrangements included within the scope of the appended claims.

What is claimed is:

1. A rewind mechanism comprising:

a housing with an opening configured to permit a flexible member to pass through the opening;

a spool rotatably connected to the inside of the housing, the spool configured to have the flexible member wound onto it;

a portion of the spool configured to engage a stop element;

a biasing element configured to apply a force to the spool in a direction that rotates the spool to rewind the flexible member onto the spool;

a track inside the housing; and an arm attached inside the housing with a portion configured to engage the flexible member, a stop portion configured to engage the portion of the spool that is configured to engage the stop element, and a guide portion configured to interact with the track inside the housing.

2. The rewind mechanism according to claim 1, further comprising:

a flexible member wound around the spool and passing through the opening in the housing with a portion of the flexible member outside the housing.

3. The rewind mechanism according to claim 2, further comprising:

a device connected to the portion of the flexible member outside the housing and configured to prevent the entirety of the flexible member from passing through the opening in the housing.

4. The rewind mechanism according to claim 3, wherein:

the device connected to the portion of the flexible outside the housing is configured to attach objects to the end of the flexible member.

5. The rewind mechanism according to claim 1, wherein:

the track is formed in a housing wall.

6. The rewind mechanism according to claim 5, wherein:

the track is configured to have four positions to which the arm guide portion configured to interact with the track moves sequentially.

7. The rewind mechanism according to claim 1, further comprising:

a plate attached to the inside of the housing; and wherein the track is formed in the plate.

8. The rewind mechanism according to claim 7, wherein:

the track is configured to have four positions to which the arm guide portion configured to interact with the track moves sequentially.

9. The rewind mechanism according to claim 7, wherein the plate is moveably attached to the inside of the housing.

10. The rewind mechanism according to claim 9, wherein:

the track is configured to have four positions to which the arm guide portion configured to interact with the track moves sequentially.

11. The rewind mechanism according to claim 1, wherein the arm portion configured to engage the flexible member comprises:

a post contained within an opening in the arm; wherein the opening in the arm is configured to permit the flexible member to pass through the arm.

12. The rewind mechanism according to claim 1, wherein the arm portion configured to engage the flexible member comprises:

a post affixed to a side of the arm.

13. The rewind mechanism according to claim 12, further comprising:

a rolling element rotatably mounted on the post.

14. The rewind mechanism according to claim 1, further comprising:

a spring configured to rotate the arm towards the spool.

15. The rewind mechanism according to claim 1, further comprising:

a locking element which is selectively moveable to a first or a second position, wherein the locking element engages the arm in the first position thereby preventing the stop portion configured to engage the portion of the spool that is configured to engage the stop element from engaging the portion of the spool that is configured to engage the stop element; and does not engage the arm in the second position thereby permitting the stop portion configured to engage the portion of the spool that is configured to engage the stop element to engage the portion of the spool that is configured to engage the stop element.

16. A method for operating a rewind mechanism comprising the steps of:

pulling on a flexible member which moves an arm to a first position that allows the flexible member to be unwound from the spool;

ceasing pulling on the flexible member which moves the arm to a second position where the arm engages the spool and prevents the flexible member from being wound onto the spool;

pulling on the flexible member a second time which moves the arm to a third position that allows the flexible member to be unwound from the spool; and ceasing pulling on the flexible member a second time which moves the arm to a fourth position where the arm does not engage the spool and allows the flexible member to be wound onto the spool.

17. The method according to claim 16, further comprising the steps of:

pulling on the flexible member a third time which moves the arm to the first position that allows the flexible member to be unwound from a spool; and ceasing pulling on the flexible member a third time which moves the arm to the second position where the arm engages the spool and prevents the flexible member from being wound onto the spool.

18. A rewind mechanism comprising:

a housing with an opening configured to permit a flexible member to pass through the opening;

a spool rotatably connected to the inside of the housing, the spool configured to have the flexible member wound onto it;

the flexible member being wound onto the spool with a portion of the flexible member extending outside the housing;

a portion of the spool configured to engage a stop element;

a biasing element configured to apply a force to the spool in a direction that rotates the spool to wind the flexible member onto the spool;

a track inside the housing; and an arm attached inside the housing, the arm comprising:

a portion configured to engage the flexible member when the flexible member is pulled and further configured to rotate the arm away from the spool when the flexible member is pulled;

a stop portion configured to engage the portion of the spool that is configured to engage the stop element; and a guide portion configured to interact with the track inside the housing.

19. The rewind mechanism according to claim 18, further comprising:

a spring configured to rotate the arm towards the spool when the flexible member is not pulled.

20. The rewind mechanism according to claim 19, wherein the arm portion configured to engage the flexible member comprises:

a post affixed to a side of the arm; and a rolling element rotatably mounted on the post affixed to a side of the arm.

* * * * *